US008172635B2

(12) United States Patent
Lin et al.

(10) Patent No.: US 8,172,635 B2
(45) Date of Patent: May 8, 2012

(54) ALIGNMENT DEVICE AND METHOD FOR ALIGNING APERTURES IN DIFFERENT PLATES

(75) Inventors: Jiunn-Nan Lin, Pingtung (TW); Ruey-Yong Deng, Pingtung (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 1339 days.

(21) Appl. No.: 11/330,225

(22) Filed: Jan. 12, 2006

(65) Prior Publication Data

US 2007/0161320 A1 Jul. 12, 2007

(51) Int. Cl.
*H01J 9/00* (2006.01)

(52) U.S. Cl. ..... 445/67; 403/80; 403/116; 403/168; 403/408.1

(58) Field of Classification Search ..... 403/98, 403/162, 243, 292, 388, 408.1, 80, 87, 112, 403/116, 167, 168; 411/508–511, 998; 248/287.1, 248/298.1, 299.1; 445/67; 361/230; 250/426
See application file for complete search history.

(56) References Cited

U.S. PATENT DOCUMENTS 1,967,145 A * 7/1934 Fisher ..... 411/998
3,182,770 A * 5/1965 Shemet ..... 403/408.1
3,687,499 A * 8/1972 Guilfoyle, Sr. ..... 403/167
3,733,655 A * 5/1973 Kolibar ..... 403/408.1
3,990,131 A * 11/1976 Okamura ..... 403/408.1
4,120,998 A * 10/1978 Olez ..... 403/243
4,235,560 A * 11/1980 Schimmel ..... 403/388
4,561,796 A * 12/1985 Hanaoka ..... 403/116
4,707,020 A * 11/1987 Enokida et al. ..... 296/191
4,929,113 A * 5/1990 Sheu ..... 403/162
5,000,610 A * 3/1991 Stuhr ..... 403/167
5,191,513 A * 3/1993 Sugiura et al. ..... 361/752
5,536,125 A * 7/1996 Gaw, Jr. ..... 411/182
5,707,244 A * 1/1998 Austin ..... 439/95
6,124,552 A * 9/2000 Boe ..... 174/135
6,188,372 B1 * 2/2001 Jackson et al.
6,267,527 B1 * 7/2001 Miller ..... 403/292
6,424,538 B1 * 7/2002 Paquin ..... 361/752
6,709,184 B1 * 3/2004 McDonald ..... 403/98
6,871,681 B2 * 3/2005 Miller ..... 403/292

* cited by examiner

*Primary Examiner* — Michael P Ferguson
(74) *Attorney, Agent, or Firm* — Birch, Stewart, Kolasch & Birch, LLP

(57) ABSTRACT

An alignment device for aligning a second aperture in a second plate with a first aperture in a first plate and an alignment method of utilizing the same. The alignment device includes a main body, a first part extending from the main body, and a second part extending from the first part. The main body comprises a first linear dimension exceeding a width of the second aperture for disposing overlying the second plate. The first part comprises a second linear dimension for extending and fitting into the second aperture. The second part comprises a third linear dimension for extending and fitting into the first aperture.

7 Claims, 9 Drawing Sheets

ALIGNMENT DEVICE AND METHOD FOR ALIGNING APERTURES IN DIFFERENT PLATES

BACKGROUND OF THE INVENTION

1. Field of the Invention

The invention relates to alignment devices and in particular to alignment devices for aligning apertures in different plates.

2. Description of the Related Art

FIG. 1 is a cross-section of an ion generator. The ion generator comprises an arc chamber (ion generation chamber) 10 for the formation of ions 12. The ions extracted from the arc chamber 10 through an aperture 22 of a plate 20 and an aperture 32 of a plate 30 become ion beams (not shown). In the ion generator, the plates 20 and 30 provide electrical potential to the ion beam to focus or scatter the ion beam, and thus, act as a G1 electrode and a G2 electrode respectively.

The plate 20 is typically combined with the arc chamber 10 and acts as a front face thereof, while the plate 30 is movable and typically fastened on a supporter 50 during operation of the ion generator. It is thus important to align the plate 30 with the plate 20, specifically to align the aperture 32 with the aperture 22. The resulting ion beam deviates as the aperture 32 deviates. The deviated ion beam cannot be introduced to a predetermined position of a target (not shown) such as a semiconductor substrate, negatively affecting the process yield.

FIG. 2 shows a conventional alignment device for aligning the aperture 32 with the aperture 22. The alignment device comprises a body 40, one alignment pin 41, and two alignment pins 42. Pins 41 and 42, extending from the body 40, respectively comprise arrow-like heads 41*a* and 42*a* fitting the widths of the apertures 22 and 33 respectively. The pin 41 is between the pins 42.

FIG. 3 is a top view showing alignment of the plate 30 with the plate 20 utilizing the alignment device shown in FIG. 2, wherein the body 40 is ignored. The central pin 41 extends through the aperture 32 to the aperture 22, while the pins 42 extend to the aperture 32. When the arrow-like heads 42*a* both completely fit the width of the aperture 32, the operator detects position of the arrow-like head 41*a*. This design asserts that the arrow-like head 41*a* completely fits the width of the aperture 22 when it extends to a predetermined position, and the apertures 22 and 32 are successfully aligned when the detection results show the arrow-like head 41*a* completely fitting the width of the aperture 22 under the condition that the arrow-like heads 42*a* both completely fit the width of the aperture 32.

As shown in FIG. 3, the plate 30 further comprises a root portion 35 fastened to the supporter 50 with a screw 52. When the plate 30 laterally rotates utilizing the screw 50 as a pivot as shown in FIG. 3, the arrow-like heads 42*a* may both completely fit the width of the aperture 32, and the arrow-like head 41*a* may simultaneously completely fit the width of the aperture 22. In this case, the apertures 32 and 22 are not aligned, but the conventional alignment device may misdirect the operator to mistakenly determine the apertures 32 and 22 are optimally aligned, resulting in deviation of the ion beam during operation of the ion generator.

Further, the arrow-like heads of the pins 41 and 42 can potentially cause other problems. For example, the central tip 41*b* of the arrow-like head 41*a* is designed to be disposed at the center line of the aperture 22 during alignment. As shown in FIG. 4, however, the central tip 41*b* potentially deviates from the center line of the aperture 22 during alignment, but it is difficult to detect this deviation because the plate 20 is at a deeper position than the operator's point of view. In some cases, the detection of the central tip 41*b* is manually performed by the operator's naked eye, and the light illumination and the operator's viewpoint potentially misdirect the operator's determination to the position of the central tip 41*b*, leading to failure of alignment.

The alignment procedures utilizing the device shown in FIG. 2 are complicated and time-consuming due to the described inconvenience introduced thereby. The alignment of the plates 30 and 20 utilizing the conventional alignment device typically requires between 1 and 2 minutes, negatively affecting product throughput and man hours.

In some cases, the abnormal utilization and handling of the conventional alignment device shown in FIG. 1 can potentially cause damage thereto. For example, accidental impact to the pins 41 and 42 incurred in a drop can potentially bend or deform the pins 41 and/or 42 with damage often not visible to the naked eye. Thus, the operator may utilize the deviated device to perform the alignment, and the alignment steps lead to misalignment of the plates 20 and 30. Further, the bent or deformed pins 41 and/or 42 cannot be repaired, and thus, it is necessary to scrap the deviated device and purchase a new one costing approximately 150 US dollars or more, negatively affecting the product cost.

As described, the alignment failure modes of utilization of the conventional alignment device are various and complicated. When ion beam deviation occurs, the repair is time-consuming, negatively affecting product throughput.

BRIEF SUMMARY OF THE INVENTION

The invention provides alignment devices and a method utilizing the same, capable of simpler alignment procedures, better alignment performance, shorter alignment time, and cheaper device cost.

The invention provides an alignment device comprising a main body, a first part extending from the main body, and a second part extending from the first part. The main body comprises a first linear dimension exceeding a width of the second aperture for disposing overlying the second plate. The first part comprises a second linear dimension for extending and fitting into the second aperture. The second part comprises a third linear dimension for extending and fitting into the first aperture.

The invention further provides an alignment method. First, a second plate with a second aperture is disposed on a side of a first plate with a first aperture. The second plate is supported but not fixed by a supporter. An alignment device is then disposed on a side of the second plate opposing the first plate, extending into the second aperture therefrom. The alignment device comprises a main body with a first linear dimension exceeding a width of the second aperture, a first part extending from the main body, with a second linear dimension, for extending and fitting into the second aperture, and a second part extending from the first part, with a third linear dimension, for extending and fitting into the first aperture. Finally, the main body at either side of the first part is observed. The position of the second plate is adjusted when the main body incompletely touches the surface of the second plate, until the main body completely touches the surface of the second plate.

The invention further provides an alignment method. A second plate with a second aperture is disposed on a side of a first plate with a first aperture, wherein the second plate is supported but not fixed by a supporter. First and second alignment devices are disposed on a side of the second plate opposing the first plate, extending into the second aperture therefrom, wherein the first and the second alignment devices respectively comprise a main body with a first linear dimension exceeding a width of the second aperture, a first part extending from the main body, with a second linear dimension, for extending and fitting into the second aperture, and a second part extending from the first part, with a third linear dimension, for extending and fitting into the first aperture. The main body on either side of the corresponding first part of the first and the second alignment devices is observed, and, when at least one of the main bodies incompletely touches the surface of the second plate, the position of the second plate is adjusted and observation repeated, and, when all of the main bodies substantially completely touch the surface of the second plate, the second plate is fastened on the supporter.

Further scope of the applicability of the invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 5A:
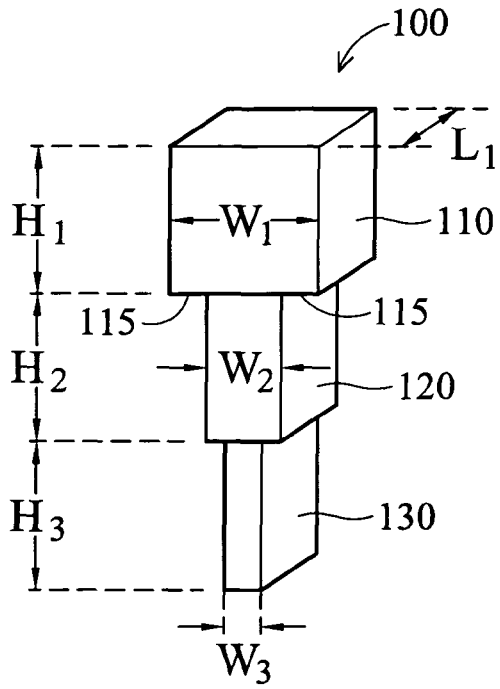
FIGS. 5A and 5B are schematic views showing an alignment device of a preferred embodiment of the invention.
Figure 5B:
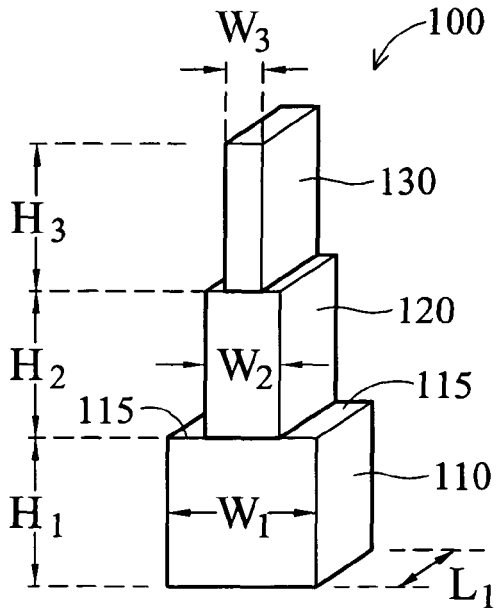

FIGS. 5A and 5B are schematic views showing an alignment device 100 of a preferred embodiment of the invention, comprising a main body 110, a first part 120, and a second part 130. The first part 120 extends from the main body 110, forming shoulders 115 on either side thereof. The second part 130 extends from the first part 120. The alignment device 100 aligns an aperture 232 in a plate 230 with an aperture 222 in a plate 220, shown in FIGS. 7A through 7C.

Figure 7A:
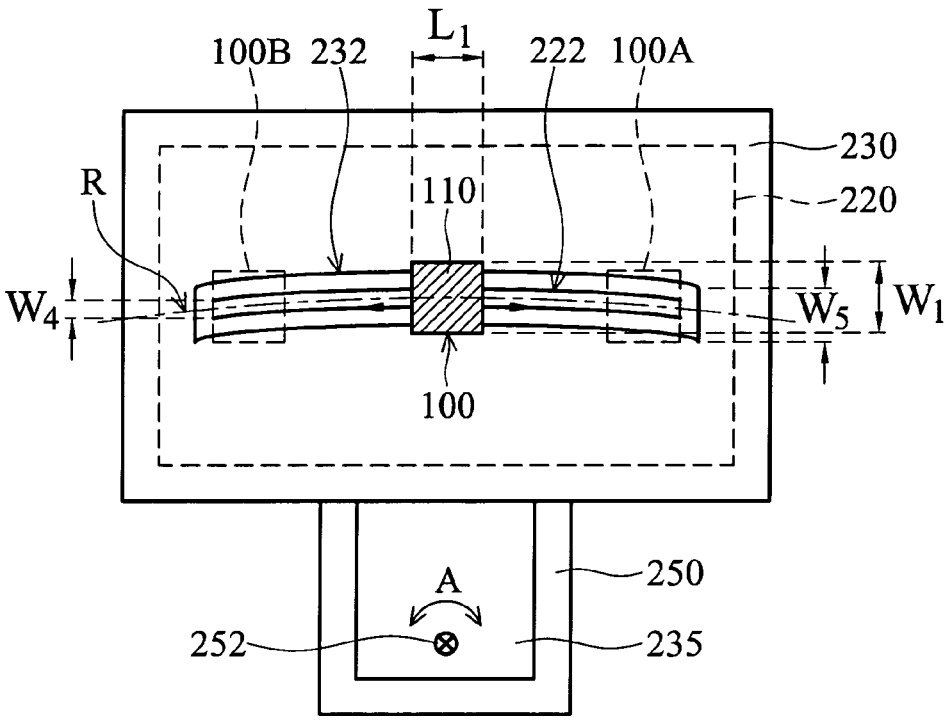
FIG. 7A is a top view showing a step of alignment methods utilizing the alignment device of the invention.

Referring to FIGS. 5A, 5B and 7A, the main body 110 comprises a linear dimension $W_1$ exceeding a width $W_5$ of the aperture 232 for disposing overlying the second plate 230 during alignment. The first part 120 comprises a linear dimension $W_2$ for extending and fitting into the aperture 232. The value of the linear dimension $W_2$ depends on that of the width W5. Specifically, the value of the linear dimension $W_2$ is slightly less than the width W5 for fitting the aperture 232 during alignment. The second part 130 comprises a linear dimension $W_3$ for extending and fitting into first aperture 222. Similarly, the value of the linear dimension $W_3$ is slightly less than a width $W_4$ of the aperture 222 for fitting the aperture 232 during alignment. Those skilled in the art may determine the values of the widths $W_4$ and $W_5$ as desired. In this embodiment, the width $W_5$ is exceeding the width $W_4$, and thus, the linear dimension $W_2$ is less than the linear dimension $W_1$ and the linear dimension $W_3$ is less than the linear dimension $W_2$. Further, those skilled in the art may determine the values of linear dimensions $H_2$ and $H_3$ of the parts 120 and 130 depending on the respective thicknesses of the plates 220 and 230 and the predetermined pitch between the plates 220 and 230. Moreover, the value of a linear dimension $H_1$ of the main body 110 can be properly selected for convenient handling of the alignment device 100.

As shown in FIGS. 5A and 5B, the alignment device 100 preferably comprises a one-piece structure utilizing a substantially rigid and tough material such as metal, ceramic, or toughened ceramics to prevent bending or deformation by utilization or handling, of which metal is preferred for cost effectiveness and simplified process. In some ion generators, the plate 230 is only supported at one end thereof, and thus, the load caused by the alignment device 100 during alignment cannot substantially bend or deform the plate 230. As a result, the alignment device 100 preferably comprises substantially rigid and tough metal with lower density such as aluminum alloys. In this embodiment, the alignment device 100 comprises aluminum alloy 6061 (specified in Aluminum Association Standard) and the cost thereof is between approximately 14 and 15 US dollars, which is the most expensive among the aluminum alloys, reducing the device cost compared with the conventional alignment device.

FIGS. 6 through 9 show a flow of alignment methods utilizing the alignment device of the invention.

Figure 1:
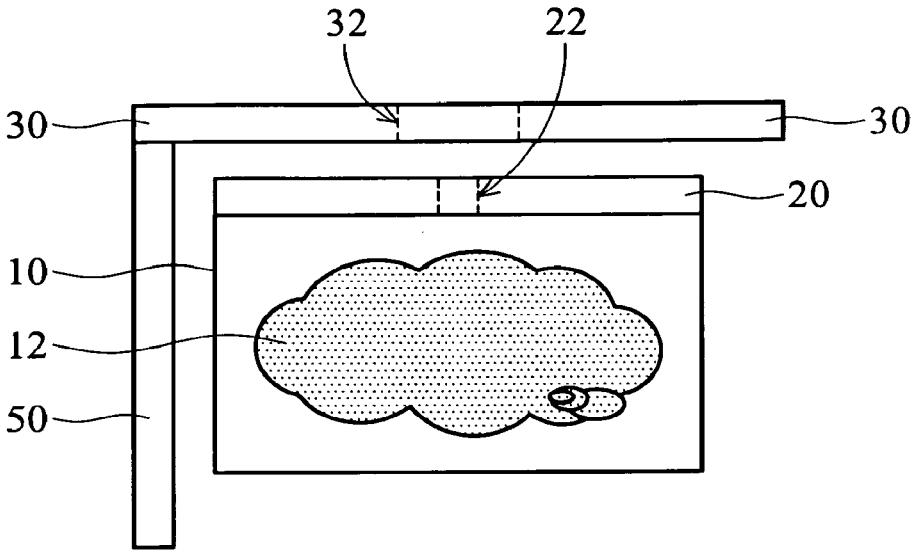
FIG. 1 (PRIOR ART)
FIG. 1 is a cross-section of an ion generator.
Figure 2:
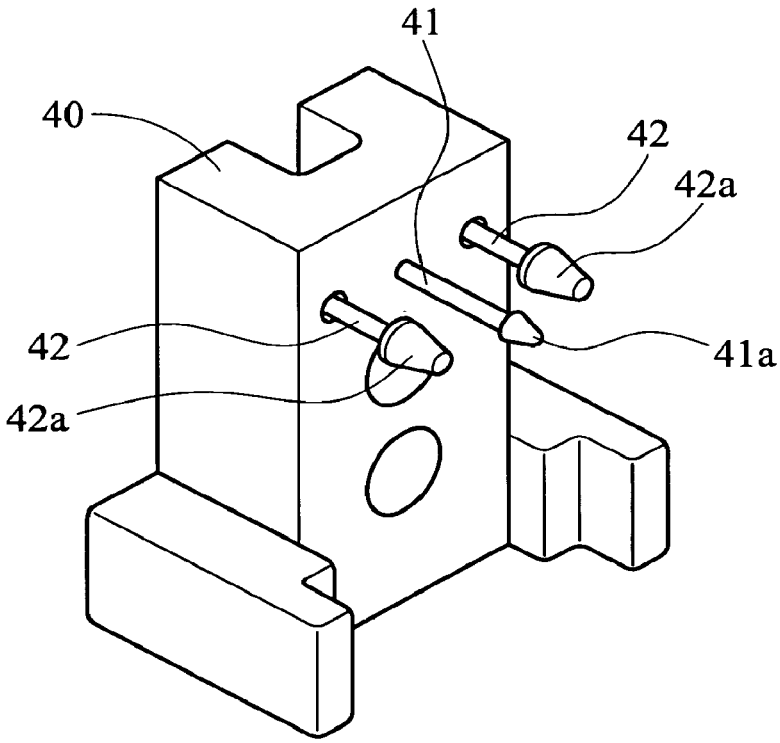
FIG. 2 (PRIOR ART)
FIG. 2 is a schematic view of a conventional alignment device for the ion generator shown in FIG. 1.
Figure 6:
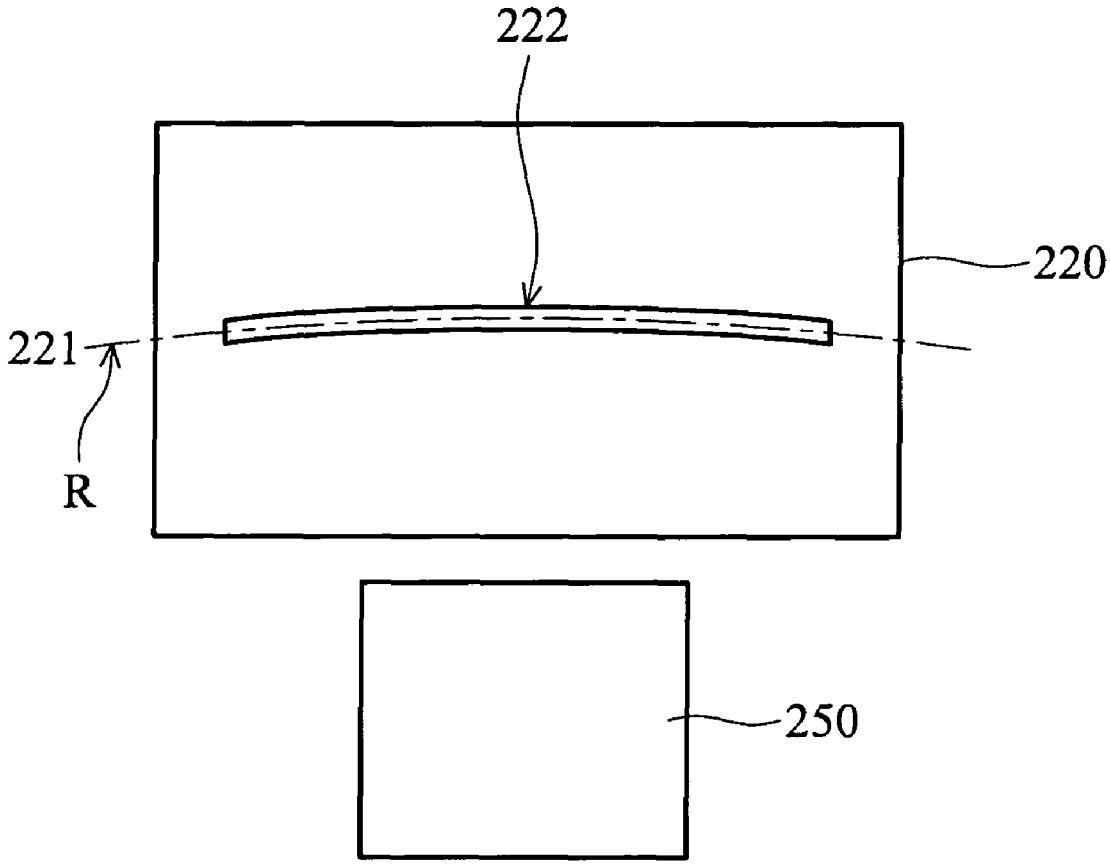
FIG. 6 is a top view showing a step of alignment methods utilizing the alignment device of the invention.

In FIG. 6, a supporter 250 and a plate 220 with an aperture 222 are provided. In some cases, the plate 220 may be combined with an arc chamber of an ion generator and acts as a front face thereof, and the supporter 250 is also comprised by the ion generator, similar to that shown in FIG. 1. In some cases, the ion generator is utilized in an ion implanter implanting ions in a semiconductor substrate.

Figure 7B:
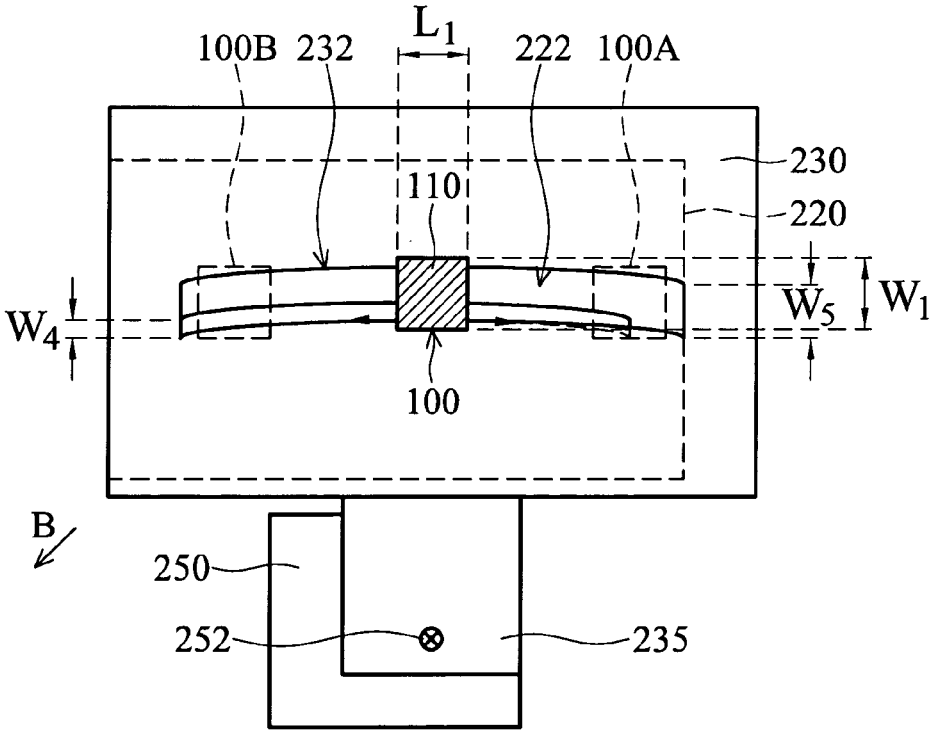
FIGS. 7B and 7C are top views showing alternative steps of that shown in FIG. 7A.

In FIG. 7A, or alternatively, FIG. 7B, a plate 230 with an aperture 232 is disposed on a side of the plate 220. In this embodiment, the plate 230 is over the plate 220. When the plate 220 is combined with the arc chamber, the plate 230 is disposed at the opposing side to the arc chamber, wherein the plates 220 and 230 respectively act as G1 and G2 electrodes of the ion generator. In this embodiment, the plate 230 optionally comprises a root portion 235 disposed on the supporter 250, and thus, the plate 230 is supported but not fixed by the supporter 250 utilizing a screw 252, for example. In alternative embodiments, the plate 230 is supported but not fixed by the supporter 250 utilizing other devices such as a clamp.

The alignment device 100 shown in FIGS. 5A and 5B is disposed on a side of the plate 230 opposing the plate 220, extending into the aperture 232 as shown in FIG. 7A, or alternatively, FIG. 7B, followed by observing the shoulders 115 of the main body 110. In these embodiments, FIGS. 7A and 7B are top views and only the main body 110 of the alignment device 100 is shown therein. The relative position of the main body 110 of the alignment device 100 to the plate 230 depends on the relative positions between the apertures 232 and 222, exemplarily shown in FIGS. 8A through 8C.

Figure 8A:
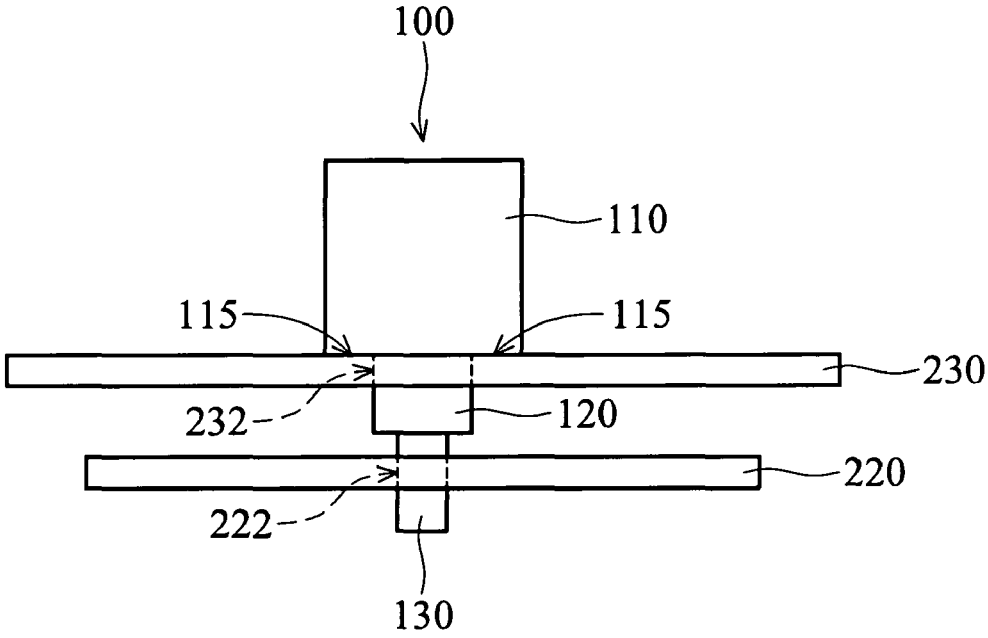
FIGS. 8A through 8C are cross-section views showing rules to determine whether the apertures are optimally aligned.

FIG. 8A is a cross-section view showing optimal alignment of the aperture 232 with the aperture 222, wherein the second part 130 of the alignment device 100 vertically extends through the plate 220 via the aperture 222, and the linear dimension W3 (shown in FIGS. 5A and 5B) substantially fits the width $W_4$ (shown in FIG. 7A) of the aperture 222. Simultaneously, the first part 120 of the alignment device 100 vertically extends through the plate 230 via the aperture 232, and the linear dimension $W_2$ (shown in FIGS. 5A and 5B) substantially fits the width $W_5$ (shown in FIG. 7A) of the aperture 222. Thus, the shoulders 115 on either side of the first part 120 can completely touch the corresponding surface of the plate 230, that is, the main body 110 can completely touch the corresponding surface of the plate 230. As a result, the operator can determine that apertures 232 and 222 are optimally aligned when the observation shows the shoulders 115 at either side of the first part 120 completely touch the corresponding surface of the plate 232.

In some embodiments, the aperture 232 is a curved slit with a radius of curvature R and a substantially constant width $W_5$ as shown in FIG. 7A. A fourth linear dimension $L_1$ (shown in FIGS. 5A and 5B) of the main body 110 is preferably between R sin 1° and R sin 2°. When the value of the fourth linear dimension L1 is beyond the range between R sin 1° and R sin 2°, the shoulders 115 (shown in FIGS. 5A and 5B) potentially incompletely touches the surface of the plate 230 during alignment even if the apertures 232 and 222 are optimally aligned.

Figure 8B:
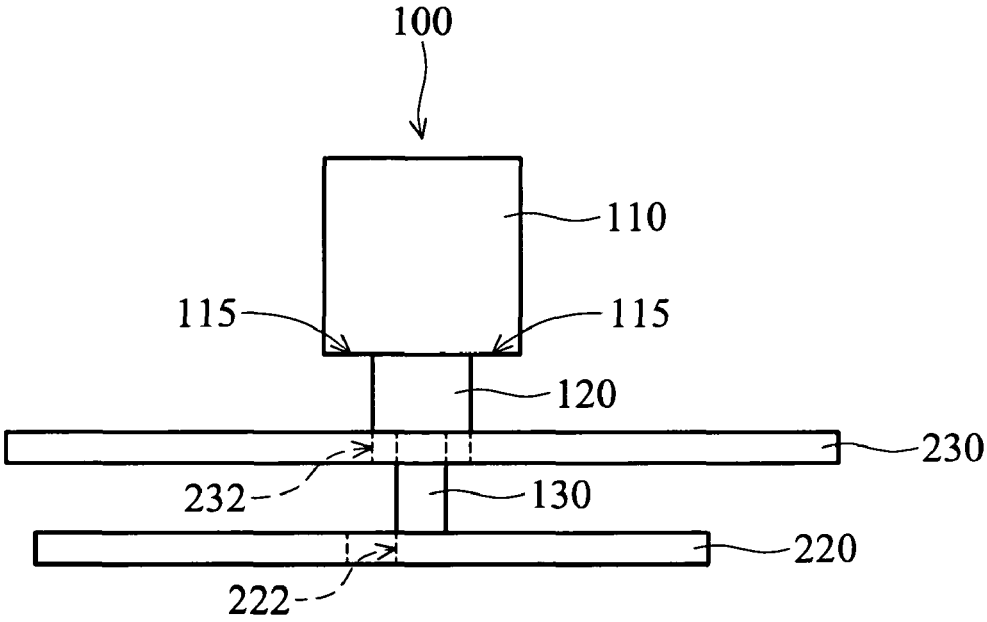

FIG. 8B is a cross-section view showing the aperture 232 apparently deviating from the aperture 222, such that the second part 130 of the alignment device 100 cannot extend into the aperture 222 and the bottom thereof touches the corresponding surface of the plate 220. The linear dimensions H3 of the second part 130 are properly selected, and thus, the shoulders 115 cannot touch the corresponding surface of the plate 232, that is, the main body 110 incompletely touches the corresponding surface of the plate 230. As a result, the operator can determine the apertures 232 and 222 are not optimally aligned when the observation shows the shoulders 115 do not touch the corresponding surface of the plate 232.

Figure 8C:
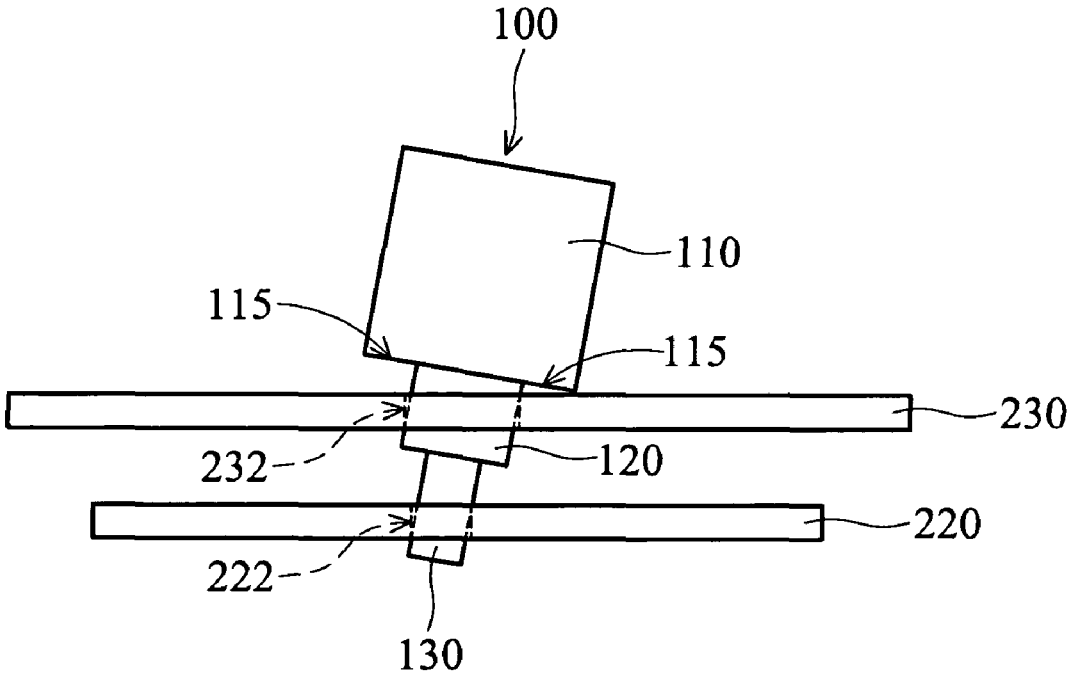

FIG. 8C is a cross-section view showing the aperture 232 slightly deviating from the aperture 222, and specifically, the deviation therebetween is as large as the tolerance between $W_3$ and $W_4$ and/or the tolerance between $W_2$ and $W_5$, or less. Thus, the second part 130 of the alignment device 100 extends non-vertically through the plate 220 via the aperture 222, and the first part 120 of the alignment device 100 non-vertically extends through the plate 230 via the aperture 232. The shoulder 115 at one side of the first part 120 can touch the corresponding surface of the plate 232, while the shoulder 115 at the other side of the first part 120 cannot touch the corresponding surface of the plate 232, that is, the main body 110 incompletely touches the corresponding surface of the plate 230. As a result, the operator can determine the apertures 232 and 222 are not optimally aligned when the observation shows only one of the shoulders 115 of the first part 120 touches the corresponding surface of the plate 232.

The position of the plate 230 is adjusted when the observation of the main body 110 shows the main body 110 incompletely touching the corresponding surface of the plate 230 as shown in FIGS. 8B and 8C, followed by observing the main body 110 of the alignment device 100 again as aforementioned. The steps of position adjustment of the plate 230 and observation of the main body 110 are repeated until the position adjustment of the plate 230 makes the main body 110 completely touch the corresponding surface of the plate 230. In some cases, the alignment device 100 can lead the position adjustment of the plate 230 until optimal alignment between the plates 230 and 220, shortening the requiring alignment time and simplifying the alignment procedure.

Figure 3:
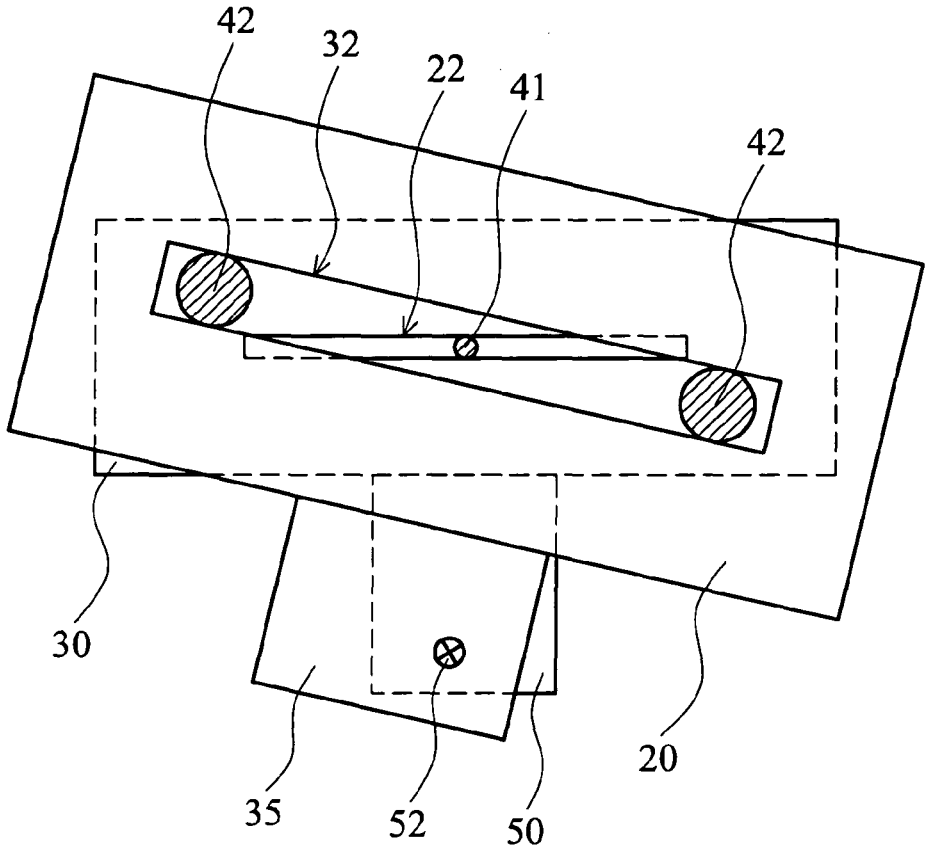
FIG. 3 (PRIOR ART)
FIG. 3 is a top view showing alignment of the plate 30 with the plate 20 shown in FIG. 1 utilizing the alignment device shown in FIG. 2.
Figure 4:
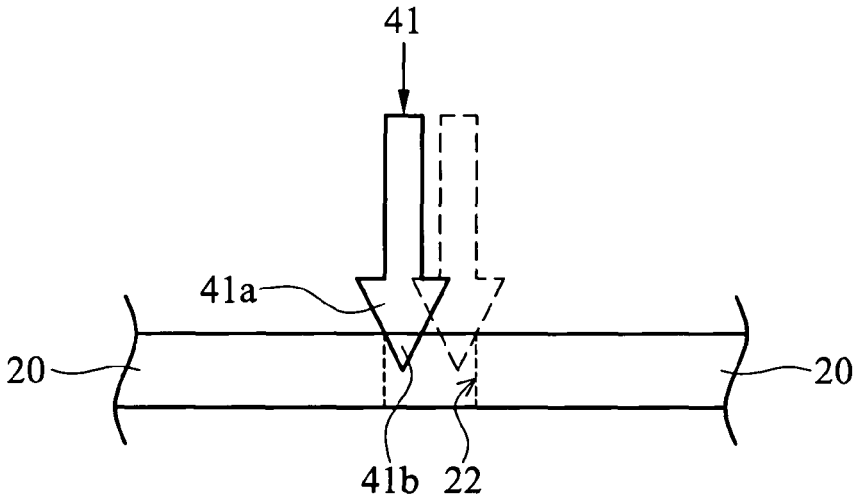
FIG. 4 (PRIOR ART)
FIG. 4 is a schematic view showing the position of the central tip 41*b* relative to the aperture 22 during alignment utilizing the alignment device shown in FIG. 2.

In some cases, the fact that the shoulders 115 at either side of the first part 120 completely touch the corresponding surface of the plate 232 means the apertures 232 and 222 where the alignment device 100 is disposed are optimally aligned, but does not mean other parts of the apertures 232 and 222 are also optimally aligned due to a similar situation as that shown in FIG. 3. As shown in FIG. 7A, or alternatively, FIG. 7B, the operator thus preferably moves the alignment device 100 along the apertures 232 and 222 and simultaneously observes the main body 110 while moving the alignment device 100. When the dynamic observation of the main body 110 shows the main body 110 incompletely touching the corresponding surface of the plate 230 as shown in FIGS. 8B and 8C, observing the main body 110 of the alignment device 100 is repeated as aforementioned. The steps of position adjustment of the plate 230 and observation of the main body 110 are repeated until the position adjustment of the plate 230 makes the main body 110 completely touch the corresponding surface of the plate 230 while moving the alignment device 100 along the apertures 232 and 222, which means the apertures 232 and 222 are substantially optimally aligned. In some cases, the movement of the alignment device 100 along the apertures 232 and 222 can lead the position adjustment of the plate 230 until optimal alignment between the plates 230 and 220, shortening the required alignment time and simplifying the alignment procedure. In one embodiment, the alignment of the plates 230 and 220 utilizing an inventive alignment device 100 as shown in FIG. 7A or 7B typically requires less than 20 seconds, much shorter than the alignment utilizing the conventional device.

In some embodiments, the position adjustment of the plate 230 is performed by rotation thereof utilizing the screw 252 as a pivot along the directional arrow A shown in FIG. 7A, for example. In some cases, the rotation may utilize other reference points in the plate 230 as a center. In alternative embodiments, the position adjustment of the plate 230 is performed by lateral movement or shift thereof along the directional arrow B shown in FIG. 7B, for example. In some cases, the plate 230 may be moved or shifted in other desired directions. In some embodiments, the position adjustment of the plate 230 is performed by a combination of rotation thereof and lateral movement or shift thereof.

Figure 7C:
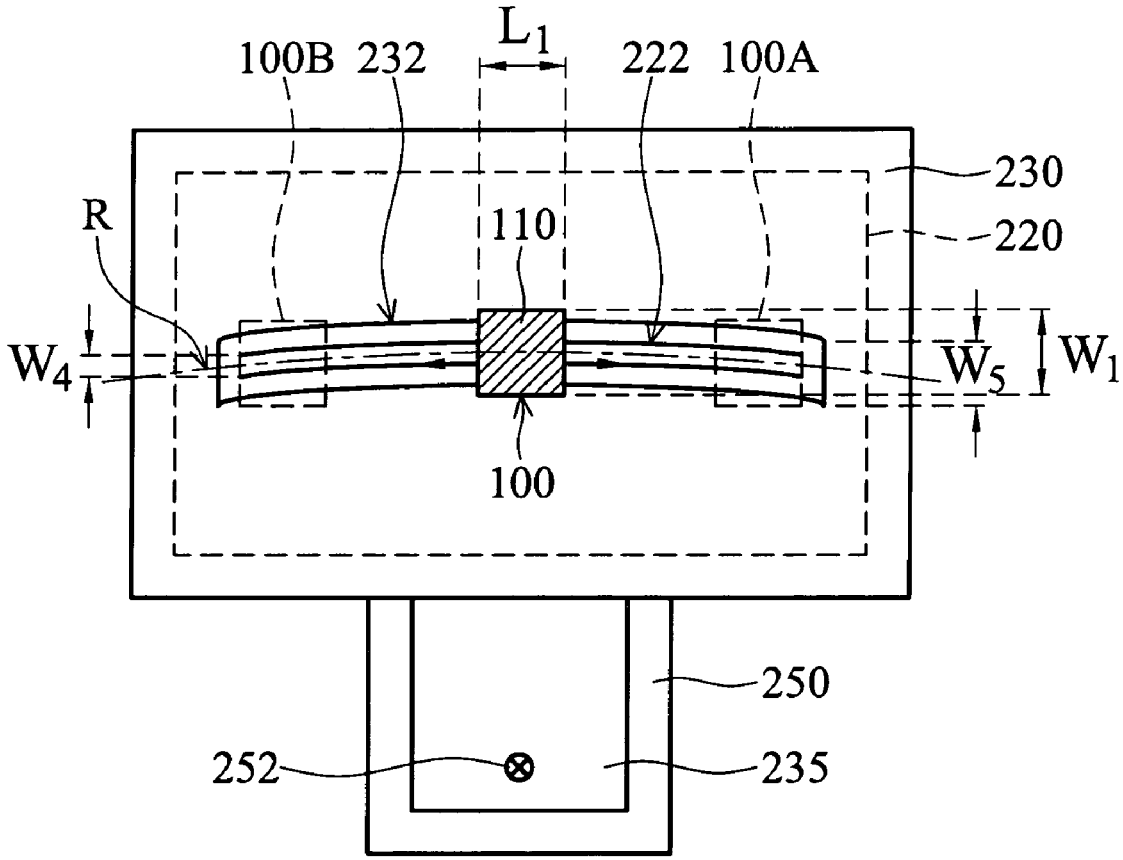

As shown in FIG. 7C, the plate 230 is fastened on the supporter 250 by the screw 252 when the apertures 232 and 222 are substantially optimally aligned. In other embodiments, the plate 230 may be fastened by other known techniques such as clamping.

Figure 9:
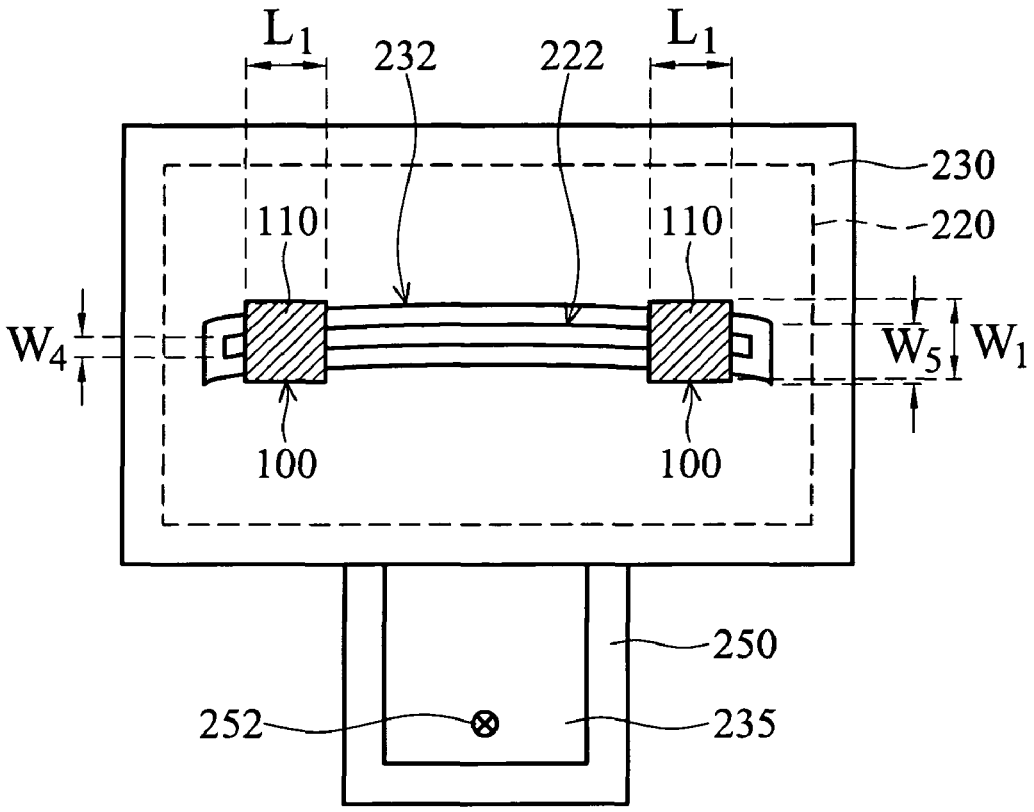
FIG. 9 is a top view showing alternative steps of that shown in FIG. 7A.

In an alternative embodiment shown in FIG. 9, the plates 230 and 220 are aligned utilizing two inventive alignment devices 100. The alignment devices 100 are disposed on a side of the plate 230 opposing the plate 220, extending into the aperture 232 after disposition of the plate 230 as described. The alignment devices 100 are preferably disposed near or at either end of the aperture 230 as shown in FIG. 9. The shoulders 115 of the main bodies 110 of the inventive alignment devices 100 are then observed according to the rules described for FIGS. 8A through 8C. The position of the plate 230 is adjusted when the observation result shows at least one of the main bodies 110 incompletely touching the corresponding surface of the plate 230. Alternatively, the second plate 230 can be fastened on the supporter utilizing the screw 252 or other techniques such as clamping when all of the main bodies 110 substantially completely touch the corresponding surface of the plate 230, which means the plates 230 and 220 are optimally aligned.

The position adjustment of the plate 230 can be performed by rotation thereof, lateral movement or shift thereof, or a combination thereof as described for FIGS. 7A and 7B. In some cases, a situation similar to that shown in FIG. 3 can potentially cause one of the main bodies 110 to completely touch the corresponding surface of the plate 230 while the other main body 110 incompletely touches the corresponding surface of the plate 230 during the alignment utilizing two inventive alignment devices 100. Thus, the position adjustment of the plate 230 can be performed by rotation thereof as described for FIG. 7A. In other cases, the situation similar to that shown in FIG. 7B can potentially cause all of the main bodies 110 to incompletely touch the corresponding surface of the plate 230 during the alignment utilizing two inventive alignment devices 100. Thus, the position adjustment of the plate 230 can be performed by lateral movement or shift thereof as described for FIG. 7B.

After the position adjustment of the plate 230, the shoulders 115 of the main bodies 110 of the inventive alignment devices 100 are again observed according to the rules described for FIGS. 8A through 8C, followed by the position adjustment of the plate 230 or fastening of the plate 230 depending on the observation results as described. The steps of the main body observation of the inventive alignment device 100 and position adjustment of the plate 230 may be repeated until the plates 230 and 220 are optimally aligned. In some cases, the alignment devices 100 can lead the position adjustment of the plate 230 until optimal alignment between the plates 230 and 220, shortening the requiring alignment time and simplifying the alignment procedure. In one embodiment, the alignment of the plates 230 and 220 utilizing the inventive alignment devices 100 as shown in FIG. 9 typically requires less than 20 seconds, much shorter than the alignment utilizing the conventional device.

After the operation of the ion generator or other apparatuses utilizing the aligned plates 230 and 220, the described alignment methods may be performed as desired. When the results show the plate 230 deviating from the optimal aligned state, the plate 230 is released and the described steps of position adjustment of the plate 230 and observation of the main body or bodies 110 are performed or repeated. The plate 230 is again fastened when the plates 230 and 220 are successfully aligned as described.

While the invention has been described by way of example and in terms of preferred embodiments, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An equipment, comprising:

a first plate with a first aperture;

a second plate with a second aperture; wherein the equipment is an ion generator comprising an arc chamber defined by the first and second plates, wherein the first plate defines a front face of the arc chamber and acts a G1 electrode and the second plate is disposed at a side of the arc chamber opposite the first plate and acts as a G2 electrode;

wherein the second plate comprises a root portion connected to a support member of the ion generator, wherein the second plate is pivotably supported on the support member utilizing a screw to pivotably connect the root portion and the support member; and an alignment device for aligning the second aperture of the second plate with the first aperture of the first plate, where in the alignment device comprises:

a main body with a first linear dimension exceeding a width of the second aperture of the second plate for overlying the second plate;

a first part extending from the main body with a second linear dimension for extending and fitting into the second aperture of the second plate, wherein the second linear dimension of the first part exceeds a width of the first aperture of the first plate for disposing the first part between the first plate and the second plate such that the first plate and the second plate do not directly contact each other; and a second part extending from the first part with a third linear dimension for extending and fitting into the first aperture, wherein each of the main body, the first part, and the second part has a rectangular cuboid shape, and each surface of the main body, the first part, and the second part is completely flat, and wherein the main body, the first part, and the second part have a first coplanar surface and a second coplanar surface opposite to the first coplanar surface; wherein the first and second parts maintain longitudinal alignment between the first and second apertures and are longitudinally slid within the first and second apertures, respectively, when the first and second plates are pivoted relative to the support member.

2. The equipment as claimed in claim 1, wherein the second aperture is wider than the first aperture.

3. The equipment as claimed in claim 1, wherein the second aperture is a curved slit with a radius of curvature R and a substantially constant width, and a fourth linear dimension of the main body is between R sin 1° and R sin 2°.

4. The equipment as claimed in claim 1, wherein the alignment device comprises aluminum alloy.

5. The equipment as claimed in claim 1, wherein the second linear dimension is less than the first linear dimension.

6. The equipment as claimed in claim 1, wherein the third linear dimension is less than the second linear dimension.

7. The equipment as claimed in claim 1, wherein the first part is thicker than the second plate.

* * * * *